United States Patent [19]

Ahl et al.

[11] Patent Number: 4,750,555

[45] Date of Patent: Jun. 14, 1988

[54] DEVICE IN A FRAME PLATE FOR A PLATE HEAT EXCHANGER

[75] Inventors: Thomas Ahl, Löddeköpinge; Torsten Peterson, Malmö, both of Sweden

[73] Assignee: Alfa-Laval Thermal AB, Lund, Sweden

[21] Appl. No.: 897,757

[22] PCT Filed: Nov. 26, 1985

[86] PCT No.: PCT/SE85/00484

§ 371 Date: Aug. 13, 1986

§ 102(e) Date: Aug. 13, 1986

[87] PCT Pub. No.: WO86/04134

PCT Pub. Date: Jul. 17, 1986

[30] Foreign Application Priority Data

Jan. 3, 1985 [SE] Sweden ..... 8500016

[51] Int. Cl.[4] ..... F28F 3/00

[52] U.S. Cl. ..... 165/166; 165/178; 285/137.1

[58] Field of Search ..... 165/166, 176, 167, 178; 285/137.1

[56] References Cited

U.S. PATENT DOCUMENTS

| | | | |
|---|---|---|---|
| 1,651,875 | 12/1927 | Ercanbrach | 165/176 |
| 1,948,380 | 2/1934 | Hope | 257/255 |
| 1,966,133 | 7/1934 | Pieper | 165/166 |
| 1,969,766 | 8/1934 | Stamsvik | 165/166 X |
| 2,012,269 | 8/1935 | Cornell, Jr. | 165/166 X |
| 2,374,574 | 4/1945 | Adams, Jr. | 285/138 |
| 3,393,731 | 7/1968 | Friedman et al. | 165/176 |
| 3,944,264 | 3/1976 | Mong et al. | 285/137.1 |
| 4,140,172 | 2/1979 | Corey | 165/178 X |
| 4,142,742 | 3/1979 | Connett et al. | 285/137.1 X |
| 4,328,862 | 5/1982 | Gossalter | 165/158 |

FOREIGN PATENT DOCUMENTS

| | | |
|---|---|---|
| 0097324 | 1/1984 | European Pat. Off. . |
| 2357059 | 5/1975 | Fed. Rep. of Germany . |
| 2654573 | 6/1977 | Fed. Rep. of Germany . |
| 2748224 | 5/1978 | Fed. Rep. of Germany . |
| 1228182 | of 1960 | France . |
| 1041805 | 9/1966 | United Kingdom . |
| 1329177 | 9/1973 | United Kingdom . |
| 2000267 | 1/1979 | United Kingdom . |
| 2005398 | 4/1979 | United Kingdom . |
| 1558575 | 1/1980 | United Kingdom . |
| 2055064 | 2/1981 | United Kingdom . |

*Primary Examiner*—Ira S. Lazarus
*Assistant Examiner*—Peggy Neils
*Attorney, Agent, or Firm*—Davis Hoxie Faithfull & Hapgood

[57] ABSTRACT

A frame plate (11) for a plate heat exchanger has two ports (12, 13), to which there are connected two tubes provided with annular flanges (16, 17). The ports (12, 13) are situated so close to each other that there is no room for the flanges (16, 17) of the two tubes to be arranged side by side. The problem is solved, according to the invention, by arranging at least one port (12), between the frame plate (11) and the annular tube flange (16), at least one removable spacing member (14) surrounding a communication channel between the port (12) and the interior of the tube, the tube flange (16), further, being connected with the frame plate (11) by means (18) separate from the spacing member (14) in a manner such that the latter is clamped between the frame plate (11) and the tube flange (16).

10 Claims, 1 Drawing Sheet

DEVICE IN A FRAME PLATE FOR A PLATE HEAT EXCHANGER

The present invention relates to a device in a frame plate for a plate heat exchanger, wherein two tubes provided with annular flanges and intended for heat exchanging media are connected with the frame plate such that the interior of each tube is in communication with a respective port in the frame plate, the distance between the centres of the ports, seen in the plane of the outer side of the frame plate, being smaller than the sum of the outer radii of the tube flanges and, therefore, the tube flanges being arranged at different distances from the frame plate.

A plate heat exchanger consists basically of a package of heat exchange plates, which are held together between one fixed and one movable frame plate. The heat exchange plates have a number of ports situated aligned with each other, such that the ports together form inlet and outlet channels through the plate package for two heat exchanging media. Usually the ports in each plate, for instance four, are arranged in pairs, two at the top and two at the bottom of the plate.

For each pair of ports in the heat exchange plates, there is a corresponding pair of ports provided in a frame plate, which latter ports are connected to two tubes for transfer of the heat exchanging media. The tubes are attached to the frame plate by means of annular flanges arranged at the tube ends. The tube flanges can either be welded directly on the tubes or loosely fitted around them and abutting against smaller stop flanges, which are fixed to the tube ends.

It has proved that at certain small heat exchangers, having a width of only a few decimeters, there has been a problem that the ports in the frame plate are situated so close to each other, that there is no room for a side by side arrangement of the tube flanges of the connecting tubes.

In a known device (see FIGS. 1 and 2), which solves the above-mentioned problem, the tube connections have been arranged such that the tube flanges are situated at different distances from the frame plate. Hereby, the tube flanges can overlap each other radially without interference. The known device comprises a joint pipe, which has an annular flange at one end adapted to be connected to a tube flange, and which is fixed at its other end, for instance welded to the frame plate.

In spite of the fact that the known device in a seemingly simple way solves the above described problem, it is associated with certain drawbacks making it expensive to produce. One drawback is that the consumption of expensive material is large. Since the kind of heat exchangers here concerned is mainly intended for aggressive media, the joint pipe and its flange must be made of an expensive, stainless material, usually stainless steel or titanium. Further, the joint pipe must be able to resist strains caused by the heat exchanging medium and the connected pipe, so the wall of the joint pipe must be made comparatively thick. In addition, the joint pipe should have such a length that there is room for mounting tools between the flange of the joint pipe and the outer side of the frame plate.

Another drawback is that a number of price raising machining operations are required for the production of the known device. The said annular flange is thus welded to the joint pipe. Further, the frame plate has a considerable thickness, because it must be able to resist pressure from the compressed heat exchange package without bulging. For cost reasons the frame plate is made of an inexpensive material, and in order that the frame plate within the port will be protected against aggressive media, the stainless joint pipe is arranged such that it extends through the port to the inner side of the frame plate. The joint pipe must be fixed within the port and, therefore, has a further flange welded at the end. The further flange is in turn welded to the inner side of the frame plate.

The said further flange must be given a certain thickness for reasons of strength. In order to avoid problems due to deflection of the heat exchange plate located nearest to the frame plate, an annular recess must be milled around the port on the inner side of the frame plate for the further flange.

A further drawback is that a device of the known kind in most countries must be approved by the authorities responsible for the issue of existing pressure vessel regulations.

To sum up, the known device requires a large consumption of expensive material and a lot of machining for its production, which leads to an expensive final product.

The object of the present invention is to seek to eliminate the above-mentioned drawbacks of the known device and, thus, to obtain a connection device, which is as simple and inexpensive as possible.

This object is obtained, according to the invention, by a device of the initially mentioned kind, which is principally characterized in that at least at one port, between the frame plate and the annular tube flange, there if arranged at least one spacing member surrounding a communication channel between the port and the interior of the tube, the tube flange, further, being connected with the frame plate by means separate from the spacing member in a manner such that the latter is clamped between the frame plate and the tube flange.

Sometimes, there are linings of stainless material, for instance rubber, plastics, stainless steel or titanium, arranged in the ports of the frame plate. At a port provided with a spacing member according to the invention, the lining preferably extends even through the spacing member, the latter being kept in a fixed position by means of flanges formed at the respective ends of the lining. Then, one of the lining flanges abuts the inner side of the frame plate, while the other lining flange is arranged between the spacing member and the tube flange. Hereby, the spacing member will not get in contact with the heat exchanging medium and, therefore, it may be made of an inexpensive non-stainless material.

Since the lining has only the aim of protecting against aggressive media, it is preferably given a small wall thickness, for instance 1 mm. This avoids the need of an annular groove on the inner side of the frame plate for the lining flange.

The small wall thickness of the lining also means that its flanges may be produced in a simple way by flaring out the ends of the lining by pressing.

In a plate heat exchanger with a lining extending through a port and the related spacing member, the latter according to the invention may be allowed to have openings in its circumference portion extending around the communication channel between the port and the interior of the connected tube. Further, within the scope of the invention, the spacing member may consist of several separate parts.

A device designed according to the invention is not concerned with existing pressure vessel regulations.

The invention is explained more closely in the following with reference to the accompanying drawing. In this, FIG. 1 shows a previously known device in connection with a frame plate.

Figure 1:
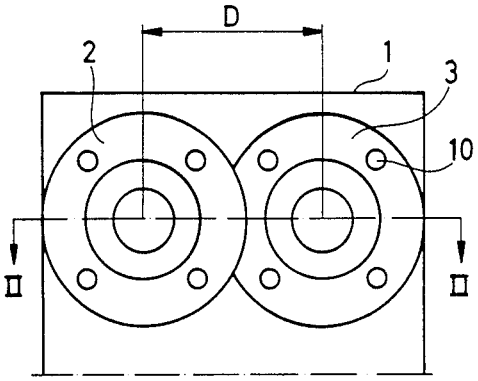
Fig.1 PRIOR ART
Figure 2:
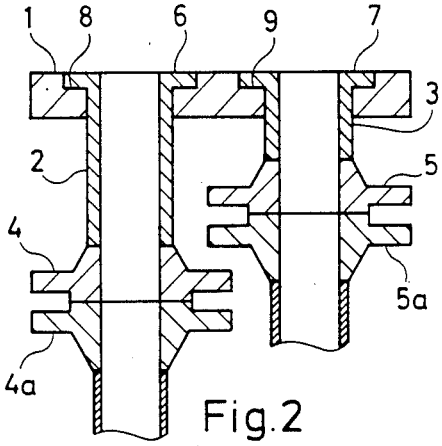
Fig.2 PRIOR ART
FIG. 2 shows a cross-section along the line II—II in FIG. 1, and connected tube flanges.

The known device shown in FIGS. 1 and 2 comprises a frame plate 1 with two ports having a distance D between their centres, seen in the plane of the outer side of the frame plate. The distance D is smaller than the sum of the outer radii of two flanges supported by two tubes, which are connected to the ports. Two joint pipes 2, 3, one 2 of which is longer than the other 3, are inserted into the ports such that they protrude to different distances from the outer side of the frame plate 1. On the protruding end portions of the joint pipes 2,3, there are welded annular flanges 4, 5, which are connected with correspondingly formed annular flanges 4*a*, 5*a* on the connecting tubes. The flanges 4, 5 of the joint pipes are provided with holes 10 intended for members connecting said flanges with the tube flanges 4*a*, 5*a*. On the other end portions of the joint pipes 2, 3, there are welded further annular flanges 6, 7. These are arranged in annular recesses 8, 9 around the ports on the inner side of the frame plate 1 and are fixed thereto, for instance by welding. The joint pipes 2, 3 and their flanges 4–7 are made of a stainless material, whereas the frame plate, which does not get in contact with any aggressive medium, is made of an inexpensive non-stainless material.

Figure 3:
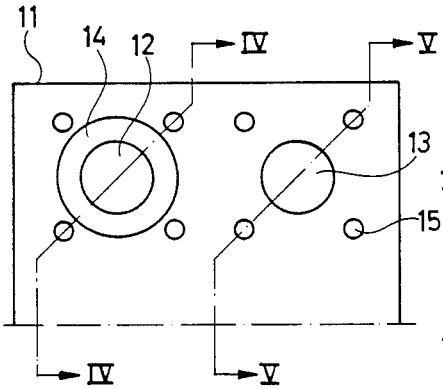
FIG. 3 shows a frame plate provided with a spacing member according to the invention.
Figure 4:
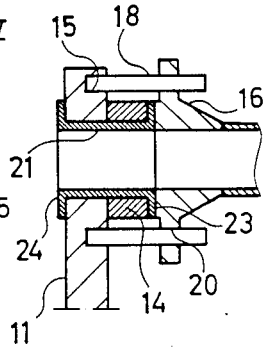
FIGS. 4 and 5 show cross-sections along the lines IV—IV and V—V, respectively, in FIG. 3, and also tube flanges and linings connected with the frame plate.
Figure 5:
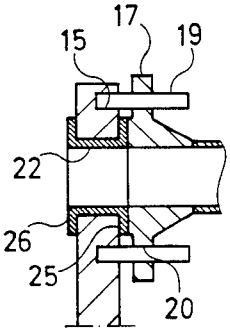

In FIGS. 3, 4 and 5, there is shown an embodiment according to the invention,

FIG. 3 shows the outer side of a frame plate 11 of a non-stainless material, which may constitute the fixed or the movable frame plate of a plate heat exchanger. Two ports 12, 13 in the frame plate are situated so close to each other that tube flanges 16, 17 of two connecting tubes (FIGS. 4 and 5) will not have room beside each other at the same distance from the frame plate (compare FIGS. 1 and 2). Around the left port 12 in FIG. 3, there is shown a removable spacing member 14 with an annular cross-section, forming a communication channel between the port 12 and the interior of a tube to be connected with the frame plate. Around each port, and radially outside the spacing member 14, the frame plate 11 has threaded holes 15.

As can be seen from FIGS. 4 and 5, the tube flanges 16, 17 are connected with the frame plate 11 by means of stud screws 18, 19, which extend through holes 20 in the tube flanges 16, 17 and are fixed in the holes 15 in the frame plate. Nuts, not shown in the drawing, are arranged on end portions of the stud screws 18, 19 extending from the holes of the tube flanges. In the ports 12, 13 there are inserted linings 21, 22 of stainless material. At the port 12 where the spacing member 14 is arranged (FIG. 4) the lining 21 extends through the latter. The lining is provided with an annular flange 23, which is fixed between the spacing member 14 and the tube flange 16. The lining 21 is provided with a further annular flange 24, which abuts the inner side of the frame plate 11.

The other port 13 (FIG. 5) has no spacing member and has, therefore, a lining 22 of a length corresponding to the thickness of the frame plate 11. Also the lining 22 is provided with annular flanges at the ends, one flange 25 arranged between the frame plate 11 and the tube flange 17, and one flange 26 abutting the inner side of the frame plate.

The spacing member 14 will not be in contact with the aggressive medium because of the lining and may, therefore, be made of an inexpensive non-stainless material, preferably the same material as the frame plate 11.

Also other embodiments than the one shown in the drawing are conceivable within the scope of the invention. Thus, spacing members may be arranged at both of the ports, having different lengths seen perpendicular to the outer side of the frame plate. Further, linings need not neccessarily be arranged in the ports. The means for connecting the tube flanges to the frame plate may also be constituted by screw bolts with heads having the same function as the nuts at the previously described stud screws.

What is claimed is:

1. A device in a frame plate for a plate heat exchanger, wherein two tubes provided with annular flanges and intended for heat exchanging media are connected with the frame plate such that the interior of each tube is in communication with a respective port in the frame plate, the distance between the centers of the ports, seen in the plane of the outer side of the frame plate, being smaller than the sum of the outer radii of the tube flanges, the tube flanges being arranged at different distances from the frame plate, comprising at least at one port between the frame plate and the annular tube flange, at least one removable spacing member surrounding a communication channel between the port and the interior of the tube, the tube flanges being connected with the frame plate by means separate from the spacing member in a manner such that the spacing member is clamped between the frame plate and the tube flange.

2. A device according to claim 1, wherein a spacing member is arranged only at one port.

3. A device according to claim 1, wherein a spacing member is arranged at each port, the spacing members having different dimensions seen perpendicular to the outer side of the frame plate.

4. A device according to claim 1, wherein the spacing member has an annular cross section and forms the communication channel.

5. A device according to claim 1, wherein the means for connection of the tube flange with the frame plate are stud screws with cooperating nuts.

6. A device according to claim 5, wherein each stud screw extends through a hole in the tube flange and is attached by one end to the frame plate perpendicularly thereto, a nut being provided on an end portion of the stud screw extending out of the hole in the tube flange.

7. A device according to claim 1, wherein the means for connection of the tube flange with the frame plate are screw bolts, which extend through holes in the tube flange and are screwed into threaded holes in the frame plate.

8. A device according to claim 1, wherein a lining of a stainless material, for instance rubber, plastics, stainless steel or titanium, is arranged in each port.

9. A device according to claim 8, wherein the lining extends through the spacing member and is provided with an annular flange, which is arranged between the spacing member and the tube flange.

10. A device according to claim 8, wherein the lining is provided with an annular flange, which abuts the inner side of the frame plate.

* * * * *